US006543544B2

(12) United States Patent
Schultz et al.

(10) Patent No.: US 6,543,544 B2
(45) Date of Patent: Apr. 8, 2003

(54) LOW POWER MINIATURE HYDRAULIC ACTUATOR

(75) Inventors: Roger L. Schultz, Aubrey, TX (US); Brock W. Watson, Carrollton, TX (US); Robert K. Michael, Plano, TX (US); James E. Masino, Houston, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 60 days.

(21) Appl. No.: 09/949,778

(22) Filed: Sep. 10, 2001

(65) Prior Publication Data

US 2002/0050354 A1 May 2, 2002

(30) Foreign Application Priority Data

Oct. 31, 2000 (WO) ..... PCT/US00/29972

(51) Int. Cl.[7] ..... E21B 43/12

(52) U.S. Cl. ..... 166/373; 166/66.6; 166/332.1

(58) Field of Search ..... 166/373, 375, 166/374, 65.1, 66.6, 66.7, 332.1

(56) References Cited

U.S. PATENT DOCUMENTS 2,240,901 A 5/1941 Ferris
5,240,077 A 8/1993 Whitsitt
5,358,035 A 10/1994 Grudzinski
5,547,029 A 8/1996 Rubbo et al.

FOREIGN PATENT DOCUMENTS

EP 0 898 084 A1 2/1999
WO 99/45231 A1 9/1999

OTHER PUBLICATIONS

International Search Report Application No.: PCT/US00/29972.

*Primary Examiner*—Frank Tsay
(74) *Attorney, Agent, or Firm*—J. Richard Konneker

(57) ABSTRACT

Electrohydraulic actuators and associated methods are utilized to control the operation of downhole well tool assemblies, representatively flow control devices. In a described embodiment thereof, each actuator is positioned downhole and comprises a self-contained, closed circuit hydraulic system including an electrically operable double action primary pump drivingly coupled to an associated well tool assembly via a first hydraulic circuit, and an electrically operable switching pump coupled to the first hydraulic circuit via a second hydraulic circuit interposed therein and operative to selectively alter the control flow of hydraulic fluid to the well tool assembly in a manner reversing its operation. To provide for selective, more rapid control of the well tool assembly, a chargeable accumulator is connected to the hydraulic circuitry and is selectively and drivably communicatable with the well tool assembly.

48 Claims, 3 Drawing Sheets

LOW POWER MINIATURE HYDRAULIC ACTUATOR

CROSS-REFERENCE TO RELATED APPLICATION

The present application claims the benefit under 35 USC §119 of the filing date of international application PCT/US00/29972, filed Oct. 31, 2000, the disclosure of which is incorporated herein by this reference.

TECHNICAL FIELD

The present invention relates generally to methods and apparatus utilized in conjunction with subterranean wells and, in an embodiment described herein, more particularly provides a compact electrohydraulic actuation system for downhole tools used in subterranean wells.

BACKGROUND

It would be desirable to be able to operate selected ones of multiple hydraulically actuated well tools installed in a well. However, it is uneconomical and practically unfeasible to run separate hydraulic control lines from the surface to each one of numerous well tool assemblies. Instead, the number of control lines extending relatively long distances should be minimized as much as possible. Additionally, it would be desirable to effect the operation of multiple hydraulically actuated well tools with a relatively low power consumption control system.

Therefore, it would be highly advantageous to provide a hydraulically-based control system and associated control methods which reduce the number of control lines extending relatively long distances between multiple hydraulically actuated well tools and the surface. The control system would preferably permit individual ones of the well tools to be selected for actuation as desired, and the selection of well tools should be convenient and reliable.

SUMMARY

In carrying out the principles of the present invention, in accordance with an embodiment thereof, a compact hydraulic actuator and associated methods are provided which solve the above problem in the art.

According to one aspect of the invention, a downhole well tool assembly, representatively a flow control device in the form of a variable inlet choke device, is controlled using a fluid power source connected thereto and including a first source of pressurized fluid operable to power the downhole well tool assembly via a first fluid circuit portion connectable to the downhole well tool assembly, and a second source of pressurized fluid having a second fluid circuit portion interposed in the first fluid circuit portion, the second source of pressurized fluid being operable to selectively alter the routing of pressurized fluid to the downhole well tool assembly. The fluid power source is preferably disposed entirely downhole, and is electrically operable.

In an illustrated embodiment of the actuator, the first source of pressurized fluid includes a reciprocating hydraulic primary pump which is coupled to the well tool assembly by the first circuit portion, and has a reversible electric drive motor. Check valves interposed in the first circuit portion the primary pump a double pumping action. The second source of pressurized fluid includes a reciprocating hydraulic switching pump used to control fluid pressure operable pilot check valves in the second fluid circuit portion and in a manner selectively reversing the fluid supply and return flow directions to the controlled well tool assembly via the first fluid circuit portion.

In the illustrated embodiment of the actuator, the actuator construction includes a body having first and second bores extending therethrough, the first and second bores respectively having radially enlarged first and second cylinder portions with opposite ends. First and second rods are reciprocably disposed in the first and second bores and have radially enlarged piston portions slidably received in the first and second cylinder portions and dividing each of them into opposing first and second hydraulic chambers that may be coupled to fluid circuitry. First and second drive portions extend outwardly from the body and have reversible electric motors respectively coupled to the first and second rods, to reciprocate them in the first and second body bores, via gearing and ball screw structures.

According to another aspect of the invention, a pilot check valve is carried in the first bore and is connectable to the first fluid circuit portion, the pilot check valve being selectively engageable ay an end portion of the first rod to disable the fluid flow blocking function of the pilot check valve.

In accordance with another aspect of the invention, a first accumulator is communicated with the first fluid circuit portion, is chargeable by the first source of fluid pressure, and is selectively communicatable with the controlled well tool assembly to rapidly open or close a control drive portion thereof. A second, smaller accumulator is preferably interconnected between the first accumulator and the first fluid circuit portion, and functions to maintain a minimum fluid pressure in the first fluid circuit portion.

In accordance with a further aspect of the present invention, a well completion is provided in the wellbore of which are provided a spaced series of downhole well tool assemblies which are representatively flow control devices in the form of variable fluid chokes. Each flow control device is operatively connected to one of the downhole hydraulic actuators, and, according to a method of the present invention, a control system is used to sense the magnitudes of predetermined operational parameters of the chokes and responsively control the operation of their associated first and second sources of pressurized fluid in a manner maintaining the magnitudes of the sensed operational parameters at predetermined levels.

Representatively, the sensed operational parameters are fluid pressure drops across the variable inlet opening areas of the chokes. In various representative embodiments of this control method, the control system is operative to maintain predetermined minimum fluid pressure drops across the inlet opening area, representatively by maintaining predetermined minimum positive exterior-to-interior fluid pressure drops across the inlet opening areas, or may be operative to maintain substantially equal fluid pressure drops across all of the variable inlet opening areas.

DETAILED DESCRIPTION

Figure 1:
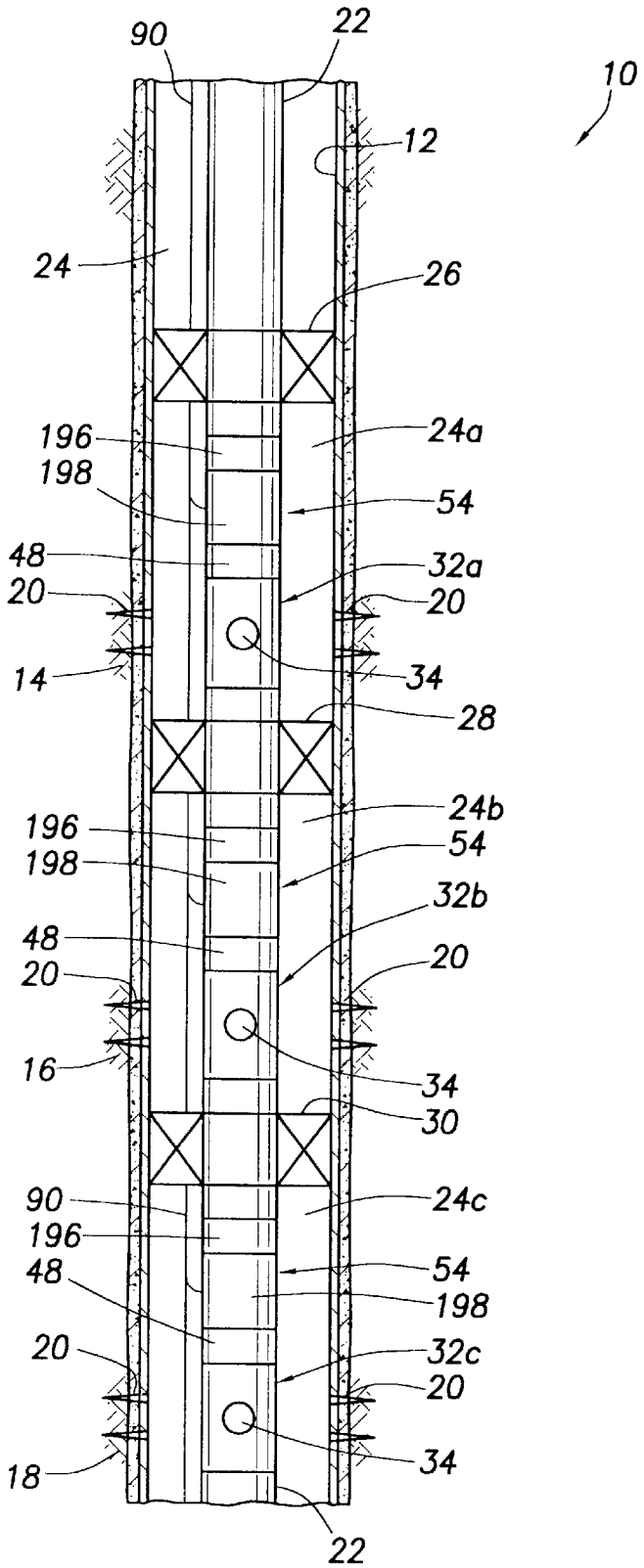
FIG. 1 is a highly schematic cross-sectional view through a portion of a subterranean well completion in which a series of well tool assemblies, representatively flow control devices, are disposed and operated by specially designed electrohydraulic actuators embodying principles of the present invention.

Representatively and schematically illustrated in FIG. 1 is a downhole portion of a subterranean well completion 10 which embodies principles of the present invention. In the following description of the well completion 10 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

The portion of the well completion 10 schematically illustrated in FIG. 1 representatively includes a generally vertical cased and cemented-in wellbore 12 which illustratively intersects three spaced apart subterranean production formations or zones 14, 16 and 18, with the usual wellbore perforations 20 communicating the production zones 14, 16 and 18 with the interior of the wellbore. Production tubing 22 is extended through the wellbore 12 and forms therewith an annular space 24. Annular packers 26, 28 and 30 are used to sealingly divide the annular space 24 into longitudinal segments 24*a*,24*b*, and 24*c* that are respectively communicated with the production zones 14, 16 and 18 via the various wellbore perforations 20.

While the apparatus and methods of the present invention described herein will be described in conjunction with the representatively vertical, cased wellbore 12 it is to be clearly understood that methods and apparatus embodying principles of the present invention may be utilized in other environments, such as horizontal or inclined wellbore portions, uncased wellbore portions, etc. Furthermore, the apparatus and methods of the present invention will be representatively described herein in terms of producing fluid from the well, but such apparatus and methods can also be utilized in injection operations without departing from principles of the present invention. As used herein, the term "wellbore" is intended to include both cased and uncased wellbores.

Still referring to FIG. 1, a plurality of well tool assemblies 32*a*, 32*b* and 32*c*, representatively hydraulically operable variable flow choke devices, are operatively installed in the production tubing 22, with the choke 32*a* being disposed between the packers 26,28 and associated with the production zone 14, the choke 32*b* being disposed between the packers 28,30 and associated with the production zone 16, and the choke 32*c* being positioned below the packer 30 and associated with the production zone 18. The chokes 32*a*–32*c* are of conventional construction, with each of them having a schematically depicted inlet opening area 34 through which production fluid entering its associated wellbore annulus portion may inwardly flow for upward transport to the surface via the interior of the production tubing 22. While three chokes 32*a*–32*c* have been representatively illustrated herein, it will be readily appreciated that a greater or lesser number of such chokes could be incorporated in the well completion 10 without departing from principles of the present invention.

Figure 2:
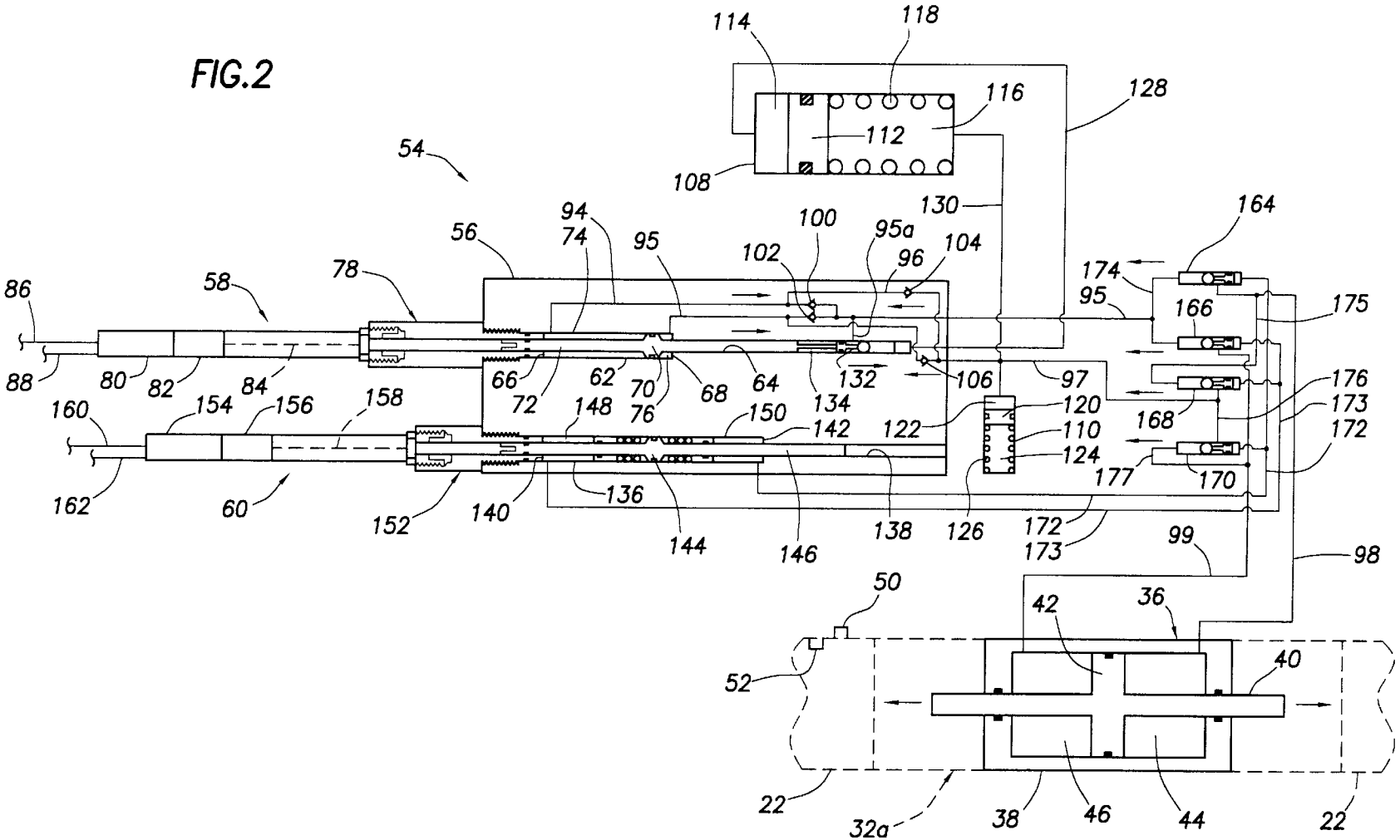
FIG. 2 is a schematic circuit diagram of one of the actuators.

One of the variable chokes, representatively choke 32*a*, is schematically depicted in FIG. 2 and has a hydraulically operable drive portion 36 that is operable in a known manner to selectively vary the inlet opening area 34 of the choke. The drive portion 36 illustratively includes a hollow cylindrical body 38 through the opposite ends of which a rod 40 slidingly and sealingly passes. Rod 40 has a radially enlarged central portion which defines a piston 42 that slidingly and sealingly engages the interior side surface of the body 38, is axially reciprocable therein, and divides the interior of the body 38 into opposite right and left chambers 44 and 46.

When the hydraulic pressure in chamber 44 is greater than that in chamber 46, the rod and piston structure 40,42 is shifted leftwardly relative to the body 38 to increase the opening area 34 of choke 32*a*. Conversely, when the hydraulic pressure in chamber 46 is greater than that in chamber 44, the rod and piston structure 40,42 is shifted rightwardly relative to the body 38 to decrease the opening area 34 of choke 32*a*. AS schematically depicted in FIG. 1, each of the chokes 32*a*,32*b*,32*c* has a position sensing section 48 operable to output a control signal indicative of the position of the rod and piston structure 42, and therefore indicative of the degree to which its associated choke is open or closed to fluid inflow. For purposes later described herein, the production tubing 22 (see FIG. 2), adjacent each of the variable chokes 32*a*,32*b*,32*c*, has associated therewith exterior and interior pressure sensors 50,52 which respectively monitor the fluid pressure exterior to the production tubing 22 and the pressure within the production tubing 22 and generate a combinative signal indicative of the pressure drop across the inlet opening area 34 of their associated choke 32.

According to a key aspect of the present invention, each of the chokes 32*a*,32*b*,32*c* is controlled by a specially designed low power miniature hydraulic actuator 54 (see FIG. 1) which is positioned downhole adjacent its associated choke and is electrically operable at a low peak wattage which is illustratively in the range of about 5–10 watts. one of the actuators 54, representatively the one associated with the choke 32*a*, will now be described with reference to FIG. 2.

Each actuator 54 includes an overall fluid power source that illustratively comprises a generally rectangularly shaped metal body 56 which carries a first fluid pressure source, representatively in the form of an electrically operable reciprocating hydraulic primary pump 58, and a second fluid pressure source, representatively in the form of an electrically operable reciprocating hydraulic switching pump 60.

Pump 58 includes a cylinder structure 62 defined by a radially enlarged portion of a circular bore 64 extending inwardly through the left end of the body 56, the cylinder 62 having left and right ends 66,68 and slidingly and sealingly receiving an enlarged central piston portion 70 of a rod 72 reciprocably received in the bore 64. Piston 70 divides the interior of the cylinder 62 into left and right opposing chambers 74 and 76, and a left end portion of the rod 72 projects outwardly through the left end of the body 56 into a cylindrical housing structure 78.

Figure 4:
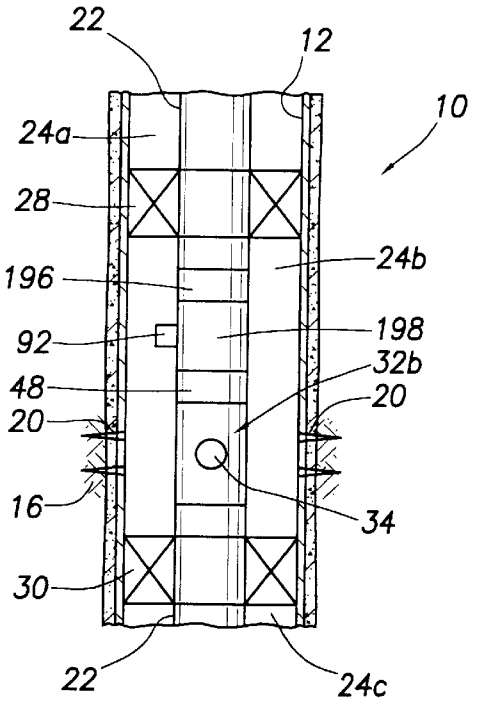
FIG. 4 is a highly schematic cross-sectional view through a portion of an alternate embodiment of the subterranean well completion shown in FIG. 1.

At the left end of the housing structure 78 is a reversible electric motor 80 which is drivingly connected, via a gear train 82, to a schematically depicted ball screw 84 which, in turn, is drivingly connected to the rod 72. Motor 80 is connected, via leads 86 and 88, to an electrical power source which, as schematically depicted in FIG. 1, is representatively disposed on the surface and extended downhole via an electrical cable 90. Alternately, the electrical power source may be disposed downhole (as schematically depicted in FIG. 4) in the form of, for example, one or more batteries 92 or another type of self-contained downhole electrical power source well known in this particular art.

A first fluid circuit portion is interconnected between the primary pump 58 and the choke drive portion 36 and includes hydraulic lines 94–99 which are interconnected as schematically shown in FIG. 2. Four check valves 100,102, 104,106 are respectively interposed as shown in the hydraulic lines 94–97, with each of these four check valves permitting fluid flow therethrough only in the direction indicated by the flow arrow adjacent such valve.

For purposes later described herein, a main fluid pressure accumulator 108 and a smaller auxiliary fluid pressure accumulator 110 are incorporated in the actuator 54. Accumulator 108 has a piston 112 slidingly and sealingly disposed therein and dividing the interior of the accumulator 108 into opposing left and right chambers 114 and 116. A coiled compression spring 118 disposed in the chamber 116 resiliently biases the piston 112 toward the left end of the accumulator 108. The smaller auxiliary accumulator 110 is of a similar construction, having a piston 120 slidingly and sealingly disposed therein and dividing the interior of the accumulator 110 into opposing top and bottom chambers 122 and 124. A coiled compression spring 126 resiliently biases the piston 120 toward the upper end of the accumulator 110.

Chamber 114 of the accumulator 108 is communicated with the right end of the body bore 64 by a hydraulic line 128, and the chamber 116 of the accumulator 108 is communicated with the hydraulic line 97, and with the chamber 122 of the accumulator 110, by a hydraulic line 130. For purposes later described herein, a mechanically operable pilot check valve 132 is disposed within the body bore 64 and is coupled between the hydraulic lines 95*a* and 128 as indicated. Under normal operation thereof the check valve 132 is open to flow therethrough from the line 95*a* to the line 128 (as indicated by the flow arrow adjacent the valve 132) but blocks flow therethrough from the line 128 to the line 95*a*. However, when a mechanical pilot force is exerted on the left end of the valve 132, its flow blocking function is disabled to permit fluid flow in either direction therethrough. This mechanical pilot force may be applied to the valve 132 by a reduced diameter right end portion 134 of the rod 72 which forcibly contacts the left end of the valve 132 when the primary pump piston 70 is stroked clear to the right or distal end 68 of the cylinder 62 as later described herein.

The switching pump 60 includes a cylinder structure 136 defined by a radially enlarged portion of a circular bore 138 extending inwardly through the left end of the body 56, the cylinder 136 having left and right ends 140,142 and slidingly and sealingly receiving an enlarged central piston portion 144 of a rod 146 reciprocably received in the bore 138. Piston 144 divides the interior of the cylinder 136 into left and right opposing chambers 148 and 150, and a left end portion of the rod 146 projects outwardly through the left end of the body 56 into a cylindrical housing structure 152.

At the left end of the housing structure 152 is a reversible electric motor 154 which is drivingly connected, via a gear train 156, to a schematically depicted ball screw 158 which, in turn, is drivingly connected to the rod 146. Motor 154 is connected, via leads 160 and 162, to the previously mentioned electrical power source.

A second fluid circuit portion is interposed in the previously described first fluid circuit portion 94–99 and is operable as later described herein to selectively alter the routing of pressurized hydraulic fluid to the choke drive portion 36. This second fluid circuit portion comprises four fluid pressure operated pilot check valves 164,166,168,170 and hydraulic lines 172–177 which are connected to the pump 60, the pilot check valves 164,166,168 and 170, and the first fluid circuit hydraulic lines 95,97,98 and 99 as schematically depicted in FIG. 2.

Each of the pilot check valves 164,166,168 and 170 is normally operable to permit fluid flow therethrough in the single direction indicated by the flow arrow adjacent the valve, but to block fluid flow in the reverse direction therethrough. However, when pilot fluid pressure is exerted on the right end of any of the check valves 164,166,168 and 170, its flow blocking function is disabled, and fluid may flow therethrough in either direction.

The switching pump 60 and its associated second fluid circuit portion just described provides the overall hydraulic circuitry of the actuator 54 with a mechanical switching logic that permits various control manipulations of the choke drive portion 36 to be carried out by selectively controlling the pilot check valves 164,166,168 and 170 to variably route pressurized hydraulic fluid to and from the chambers 44 and 46 of the choke drive portion 36.

Switching pump 60 may be controlled to position its piston 144 in a selected one of three positions within its cylinder 136—(1) a centered position (shown in FIG. 2) in which all of the pilot check valves 164,166,168 and 170 are operative to permit fluid flow leftwardly therethrough, but block fluid flow rightwardly therethrough; (2) a rightwardly shifted position in which pilot fluid pressure from the right cylinder chamber 150 is transmitted via hydraulic line 172 to the right ends of the check valves 164 and 170 to disable their fluid flow blocking functions and thereby permit both leftward and rightward fluid flow therethrough while the check valves 166,168 continue to preclude rightward fluid flow therethrough; and (3) a leftwardly shifted position in which pilot fluid pressure from the left cylinder chamber 148 is transmitted via hydraulic line 173 to the right ends of the check valves 166,168 to disable their fluid flow blocking functions and thereby permit both leftward and rightward fluid flow therethrough while the check valves 164,170 continue to preclude rightward fluid flow therethrough.

During normal operation of the primary hydraulic pump 58 its electric motor 80 is cyclically reversed to cause reciprocation of the piston 70 within its cylinder 62 between left and right limit positions inwardly offset from the opposite ends 66,68 of the cylinder 62. During this normal reciprocating operation of the primary hydraulic pump 58, the piston 70 does not reach the right or distal end of the cylinder 62. Accordingly, the pilot check valve 132 is not forcibly contacted by the right end portion 134 of the rod 72 and thus continues to block fluid flow leftwardly therethrough.

To move the choke drive piston 42 in a leftward opening direction, the switching pump piston 144 is driven rightwardly from its centered position within the cylinder 136 to pressurize line 172 and disable the fluid blocking functions of the pilot check valves 164 and 170, and the main pump piston 70 is caused to reciprocably stroke in its normal pumping mode. On each rightward stroke of the main pump piston 70, an incremental amount of pressurized hydraulic fluid is forced into the choke drive portion chamber 44 from the primary pump chamber 76 sequentially through the lines 95 and 174, the pilot check valve 164, and the line 98. With the accumulator 108 being previously charged in a manner later described herein, pressurized hydraulic fluid in the accumulator chamber 114 is communicated (via line 128) with the right end of the bore 64 to thereby prevent rightward flow of fluid through the pilot check valve 132.

Entry of pressurized hydraulic fluid into the choke drive portion chamber 44 drives the piston 42 leftwardly a small distance within the body 38 and forcibly returns a corresponding incremental volume of hydraulic fluid from the choke drive portion chamber 46 into the left chamber 74 of the primary pump 58 sequentially through lines 99 and 177, pilot check valve 170, and lines 176, 97, 96 and 94. The presence of the four check valves 100,102,104,106 in the hydraulic circuitry of the actuator 54 provides the primary pump 58 with a double pumping action such that when the primary pump piston 70 is subsequently stroked in a leftward direction within the cylinder 62 another incremental volume of pressurized hydraulic fluid is forced into the choke drive portion chamber 44—this time from the left cylinder chamber 74 sequentially through lines 94, 95 and 174, pilot check valve 164, and line 98. The resulting leftward incremental movement of the choke drive portion piston 42 forcibly returns a corresponding volume of hydraulic fluid to the right main pump chamber 76 sequentially through lines 99 and 177, the pilot check valve 170, and the lines 176, 97 and 95.

To move the choke drive portion piston 42 in a rightward closing direction, the primary pump 58 is operated in its normal reciprocating pumping mode with the switching pump piston 144 leftwardly shifted from its center position to thereby pressurize line 173 and disable the fluid blocking function of the pilot check valves 166 and 168. During a rightward stroke of the primary pump piston 70, an incremental volume of pressurized hydraulic fluid is forced into the left choke drive portion chamber 46 from the primary pump chamber 76 sequentially through lines 95 and 174, pilot check valve 166 and line 199. The resulting rightward incremental movement of the choke drive portion piston 42 forcibly returns a corresponding volume of hydraulic fluid to the left primary pump chamber 74 sequentially via lines 98 and 175, pilot check valve 168, and lines 176, 97, 96 and 94.

During the subsequent leftward stroke of the primary pump piston 70, an incremental amount of pressurized hydraulic fluid is forced into the left choke drive portion chamber 46 from the left main pump chamber 74 sequentially through lines 94, 95 and 174, the pilot check valve 166 and the line 99. The resulting rightward incremental movement of the piston 42 forcibly returns a corresponding incremental volume of hydraulic fluid from the right choke drive portion chamber 44 to the right primary pump chamber 76 sequentially through the lines 98 and 175, the pilot check valve 168, and lines 176, 97 and 94. As will be appreciated, the total opening or closing distance that the choke drive portion piston 42 is moved corresponds (for a given piston stroke distance) to the total number of pumping strokes imparted to the primary pump piston 70 by its associated reversible electrical drive motor 80.

As just described, the choke drive portion piston 42 may be incrementally driven by the electrohydraulic actuator 54 leftwardly or rightwardly to progressively (and rather slowly) increase or decrease the inlet opening area 34 of its associated variable choke 32*a* (see FIG. 1). Additionally, in a manner which will now be described with continuing reference to FIG. 2, the accumulator 108 may be selectively utilized to effect a rapid total opening or total closing of the variable choke 32*a* if conditions warrant.

To ready the accumulator 108 for its rapid choke opening and closing functions, it is first charged by reciprocating the main pump piston 70 in its normal pumping mode while the switching pump piston 144 is in its centered position in which all four of the pilot check valves 164,166,168 and 170 block rightward fluid flow therethrough. This reciprocation of the primary pump piston 70 pressurizes the chamber 114 of the accumulator 108, via lines 94, 95 and 95*a*, the pilot check valve 132, and the line 128, and correspondingly compresses the accumulator spring 118. This pressurization of the accumulator chamber 114 also serves to pressurize the chamber 122 of the smaller auxiliary accumulator 110 and compress its spring 126. The charged auxiliary accumulator 110 functions, via its connection to line 97, to maintain a predetermined minimum pressure in the first fluid circuit portion of the actuator 54.

When it is desired to relatively rapidly open the choke 32*a*, the switching pump piston 144 is moved rightwardly away from its centered position to thereby pressurize line 172 and disable the fluid blocking functions of pilot check valves 164 and 170. The main pump piston 70 is then stroked to its distal or rightmost limit position which causes the right end portion 134 of the rod 72 to forcibly engage the pilot check valve 132 and disable its fluid blocking function. This causes pressurized hydraulic fluid in the accumulator chamber 114 to be flowed into the right choke drive portion chamber 44 (sequentially via line 128, pilot check valve 132, lines 95*a*, 95 and 174, pilot check valve 164 and line 98) to relatively rapidly drive the piston 42 leftwardly and fully open the choke 32*a*.

When it is desired to relatively rapidly close the choke 32*a*, the switching pump piston 144 is moved leftwardly away from its centered position to thereby pressurize line 173 and disable the fluid blocking functions of pilot check valves 166 and 168. The main pump piston 70 is then stroked to its distal or rightmost limit position which causes the right end portion 134 of the rod 72 to forcibly engage the pilot check valve 132 and disable its fluid blocking function. This causes pressurized hydraulic fluid in the accumulator chamber 114 to be flowed into the left choke drive portion chamber 46 (sequentially via lines 128, pilot check valve 132, lines 95*a*, 95 and 174, pilot check valve 166 and line 99) to relatively rapidly drive the piston 42 rightwardly and fully close the choke 32*a*.

Figure 3:
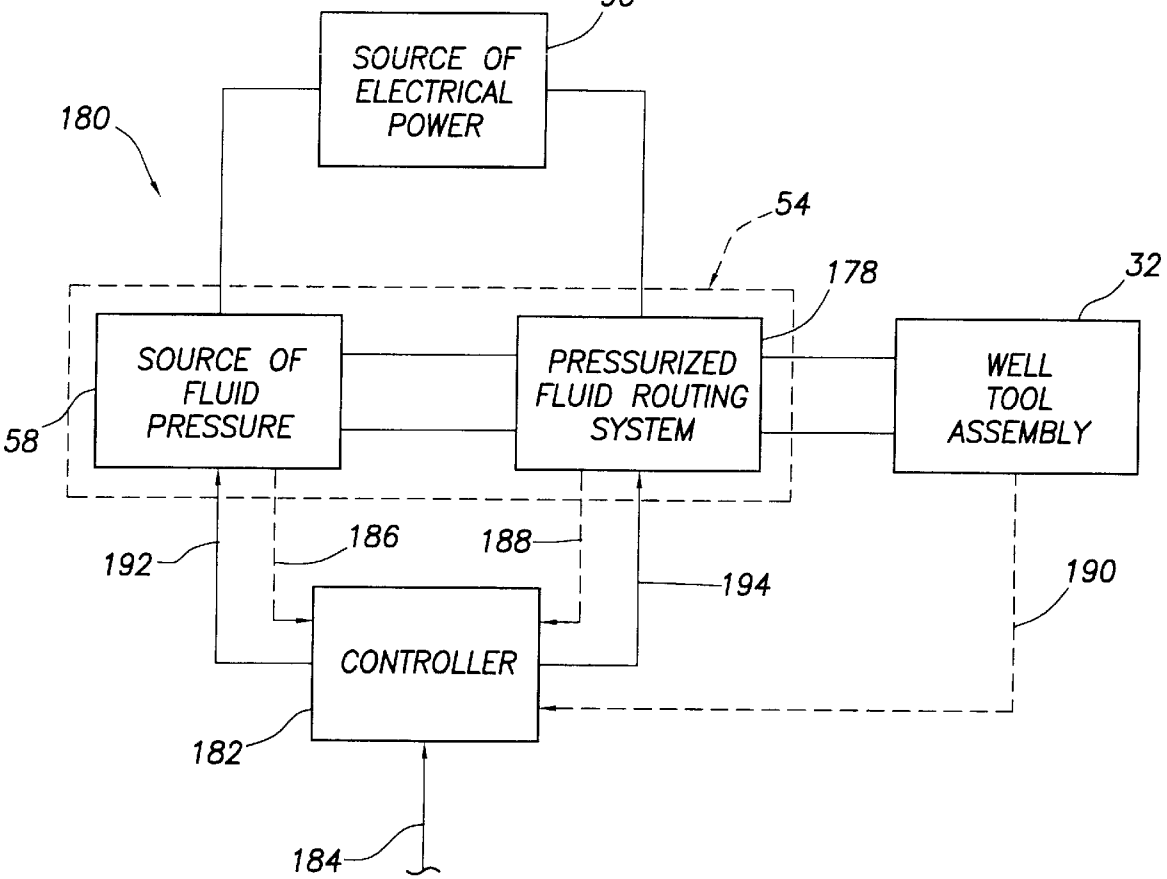
FIG. 3 a schematic control diagram for a representative one of the actuators.

Turning now to FIG. 3, at each variable choke 32 (or other well tool assembly as the case may be), the actuator 54 with its source of fluid pressure 58 and its pressurized fluid routing system 178 (representatively the switching pump 60 and its associated pilot check valves and hydraulic circuitry) are powered by a source of electrical power such as via the electrical cable 90 connected to a surface electrical power source, and are incorporated in a control system 180 used to monitor and responsively control the operation of the variable choke 32 with which it is associated.

A suitable electronic controller 182 is incorporated into the control system 180, and is utilized to control an operating parameter of its associated variable choke 32, representatively the outside-to-inside fluid pressure drop (as sensed by the exterior and interior pressure sensors 50,52 shown in FIG. 2) at the production tubing 22 adjacent the choke. In this manner, with a control system 180 operatively associated with each of the chokes 32*a*–32*c*, the fluid pressure drop at each choke may be controlled to provide a variety of production operational characteristics, such as assuring that a minimum positive exterior-to-interior pressure drop exists at each variable choke (to prevent unwanted zone-to-zone fluid transfer), maintaining essentially identical fluid pressure drops at each choke, etc.

As schematically indicated in FIG. 3, a desired choke operating parameter value signal 184 (such as a desired minimum fluid pressure drop across the choke) is appropriately input to the controller 182 which also respectively receives operational feedback signals 186,188,190 from the fluid pressure source 58, the pressurized fluid routing system 178 and the choke 32. Representatively, the feedback signal 186 can include one or more sensed operating parameters of the main pump 58 such as the position of its piston 70, the feedback signal 188 can include one or more sensed operating parameters of the switching pump 60 such as the position of its piston 144, and the feedback signal 190 can include one or more sensed operating parameters of the choke 32 such as the position of its drive piston 42 (as monitored by the choke's position sensing section 48) and the adjacent production tubing fluid pressure drop (as transmitted from its pressure sensors 50 and 52).

In response to the receipt of these feedback signals 186,188,190 the controller 182 respectively transmits control signals 192,194 to the pumps 58 and 60 to regulate their operation in a manner maintaining the controlled operating parameter of the choke 32 at a magnitude corresponding to that set by the operating parameter set point signal 184 transmitted to the controller 182.

In addition to desirably requiring only a relatively low electrical power input, each self-contained, closed circuit actuator 54 is quite compact, and does not require any hydraulic line connection to any surface equipment. Accordingly, as can be seen in FIGS. 1 and 4, none of the wellbore space needs to be dedicated to hydraulic lines routed from the surface to the actuators 54. Additionally, when the electrical power source 92 for each actuator 54 is located downhole, as schematically illustrated in FIG. 4, no well bore space is taken up by electrical lines routed from the surface to the actuators 54.

Representatively, each actuator 54 is compactly mounted on the production tubing 22 (see FIG. 1) in generally annular housings 196 and 198 which outwardly circumscribe the production tubing 22 just above the position sensing section 48 of each choke 32. The accumulator portions 108,110 of each actuator 54 are disposed within the housings 196, with controllers 182 and the balances of the actuators 54 being disposed in the housings 198.

While the well tool assemblies 32 representatively illustrated and described herein are variable choke assemblies, the actuators 54 could also be operatively associated with a wide variety of other types of well tool assemblies as well without departing from principles of the present invention. For example, the actuators 54 could be operatively associated with other types of flow control devices such as sliding sleeve devices, safety valves, variable flow area sand screens, and the like. Also, the actuators 54 could be operatively associated with various non-flow control types of downhole well tool assemblies such as, for example, packer structures.

Additionally, while the first and second sources of pressurized fluid incorporated in the self-contained, closed circuit actuators 54 have been representatively illustrated and described herein as being reciprocable hydraulic pumps, it will be readily appreciated by those of ordinary skill in this particular art that other types of pumps, as well as other types of non-pump sources of pressurized fluid, could alternatively be utilized without departing from principles of the present invention.

Of course, a person skilled in the art would, upon a careful consideration of the above description of representative embodiments of the invention, readily appreciate that many modifications, additions, substitutions, deletions, and other changes may be made to the specific embodiments, and such changes are contemplated by the principles of the present invention. Accordingly, the foregoing detailed description is to be clearly understood as being given by way of illustration and example only, the spirit and scope of the present invention being limited solely by the appended claims.

What is claimed is:

1. Apparatus for controlling operation of a downhole well tool assembly, comprising:

a fluid power source including:

a first source of pressurized fluid operable to power the downhole well tool assembly via a first fluid circuit portion connectable to the downhole well tool assembly, and a second source of pressurized fluid having a second fluid circuit portion interposed in the first fluid circuit portion, the second source of pressurized fluid being operable to selectively alter the routing of pressurized fluid to the downhole well tool assembly.

2. The apparatus of claim 1 wherein the fluid power source is a self-contained, closed circuit fluid power source positionable downhole with the well tool assembly.

3. The apparatus of claim 1 wherein the first and second sources of pressurized fluid are electrically operable.

4. The apparatus of claim 1 wherein the first source of pressurized fluid includes a reciprocating hydraulic pump having a reversible electric drive motor.

5. The apparatus of claim 4 wherein the first fluid circuit portion includes check valve apparatus interposed therein and operative to provide the hydraulic pump with a double pumping action.

6. The apparatus of claim 1 wherein the second source of pressurized fluid includes a reciprocating hydraulic pump having a reversible drive motor.

7. The apparatus of claim 6 wherein the second fluid circuit portion includes a plurality of pilot check valves connected to receive fluid pilot pressure from the hydraulic pump.

8. The apparatus of claim 1 further comprising a pressurized fluid accumulator communicated with the first fluid circuit portion and selectively operable to power the downhole well tool assembly via the first fluid circuit portion.

9. The apparatus of claim 8 wherein the pressurized fluid accumulator is selectively chargeable by the first source of pressurized fluid.

10. The apparatus of claim 8 wherein the pressurized fluid accumulator is a first fluid pressure accumulator, and the apparatus further comprises a second fluid pressure accumulator in fluid pressure communication with the first accumulator and the first fluid circuit portion, the second accumulator being operative to maintain a predetermined minimum fluid pressure in the first fluid circuit portion.

11. The apparatus of claim 1 further comprising control apparatus for sensing the magnitude of a predetermined operational parameter of the well tool assembly and responsively controlling the operation of the first and second sources of pressurized fluid in a manner maintaining the magnitude of the sensed operational parameter at a predetermined level.

12. The apparatus of claim 1 wherein:

the first and second sources of pressurized fluid are electrically operable, and the apparatus further comprises an electrical power source operably connectable to the first and second sources of pressurized fluid.

13. The apparatus of claim 12 wherein the electrical power source is a self-contained power source positionable entirely downhole.

14. A method of controlling operation of a downhole well tool assembly, the method comprising the steps of:

connecting to the well tool assembly a fluid power source including a first source of pressurized fluid operable to power the downhole well tool assembly via a first fluid circuit portion connected thereto, and a second source of pressurized fluid having a second fluid circuit portion interposed in the first fluid circuit portion, the second source of pressurized fluid being operable to selectively alter the routing of pressurized fluid to the downhole well tool assembly; and operating the first and second sources of pressurized fluid.

15. The method of claim 14 wherein the connecting step includes the step of positioning the fluid power source entirely downhole.

16. The method of claim 14 wherein:

the well tool assembly is carried on a tubular downhole structure, and the connecting step includes the step of mounting the fluid power source on the tubular downhole structure adjacent the well tool assembly.

17. The method of claim 14 wherein the operating step is performed by electrically operating the first and second sources of pressurized fluid.

18. The method of claim 14 further comprising the steps of:

sensing the magnitude of a predetermined operational parameter of the well tool assembly, and responsively controlling the operation of the first and second sources of pressurized fluid in a manner maintaining a predetermined magnitude of the sensed operational parameter.

19. The method of claim 14 wherein the connecting step includes the steps of:

connecting a reciprocating hydraulic primary pump to the first fluid circuit portion, and connecting a reciprocating hydraulic switching pump to the second fluid circuit portion.

20. The method of claim 19 wherein the connecting step further comprises the steps of:

interposing a plurality of pilot check valves in the first fluid circuit portion, and connecting the switching pump to the pilot check valves.

21. The method of claim 19 wherein:

the connecting step further comprises connecting an accumulator in the first fluid circuit, and the method further comprises the step of using the first source of pressurized fluid to charge the accumulator.

22. The method of claim 21 further comprising the step of:

utilizing a selectively variable one of the first source of pressurized fluid and the charged accumulator to power the downhole well tool assembly.

23. A subterranean well completion comprising:

a wellbore;

a series of well tool assemblies disposed in the wellbore;

multiple self-contained, electrically operable hydraulic pressure sources interconnected to corresponding ones of the well tool assemblies and useable to control their operation, each self-contained hydraulic pressure source being disposed downhole and including a first source of pressurized fluid operable to power the associated downhole well tool assembly via a first fluid circuit portion connected thereto, and a second source of pressurized fluid interposed in the first fluid circuit portion, the second source of pressurized fluid being operable to selectively alter the routing of pressurized fluid to the associated downhole well tool assembly; and at least one source of electrical power operably coupled to the hydraulic pressure sources.

24. The subterranean well completion of claim 23 wherein the electrically operable hydraulic pressure sources are free from physical extensions thereof to the surface.

25. The subterranean well completion of claim 23 wherein each source of electrical power is positioned downhole and is free from physical extensions thereof to the surface.

26. The subterranean well completion of claim 23 wherein each first source of pressurized fluid includes a reciprocating hydraulic pump having a reversible electric motor.

27. The subterranean well completion of claim 26 wherein each first fluid circuit portion includes check valve apparatus interposed therein and operative to provide its associated hydraulic pump with a double pumping action.

28. The subterranean well completion of claim 23 wherein each second source of pressurized fluid includes a reciprocating hydraulic pump having a reversible drive motor.

29. The subterranean well completion of claim 28 wherein each second fluid circuit portion includes a plurality of pilot check valves connected to receive fluid pilot pressure from the associated hydraulic pump.

30. The subterranean well completion of claim 23 further comprising, for each hydraulic pressure source, a pressurized fluid accumulator communicated with the first fluid circuit portion and selectively operable to power the associated downhole well tool assembly via the first fluid circuit portion.

31. The subterranean well completion of claim 30 wherein, for each hydraulic pressure source, the pressurized fluid accumulator is selectively chargeable by the first source of pressurized fluid.

32. The subterranean well completion of claim 30 wherein, for each hydraulic pressure source, the pressurized fluid accumulator is a first fluid pressure accumulator, and the subterranean well completion further comprises, for each hydraulic pressure source, a second fluid pressure accumulator in fluid pressure communication with the first accumulator and the first fluid circuit portion, the second accumulator being operative to maintain a predetermined minimum fluid pressure in the first fluid circuit portion.

33. The subterranean well completion of claim 23 further comprising control apparatus for sensing the magnitudes of predetermined operational parameters of the well tool assemblies and responsively controlling the operation of their associated first and second sources of pressurized fluid in a manner maintaining the magnitudes of the sensed operational parameters at predetermined levels.

34. The subterranean well completion of claim 33 wherein:

the downhole well tool assemblies are flow control devices mutually spaced apart along the length of the wellbore and having variable opening areas communicating exterior and interior portions thereof, and the sensed operational parameters are fluid pressure drops across the inlet opening areas.

35. The subterranean well completion of claim 34 wherein the flow control devices are variable choke devices.

36. The subterranean well completion of claim 34 wherein the control apparatus is operative to maintain predetermined minimum fluid pressure drops across the inlet opening areas.

37. The subterranean well completion of claim 36 wherein the control apparatus is operative to maintain minimum positive exterior-to-interior fluid pressure drops across the inlet opening areas.

38. The subterranean well completion of claim 34 wherein the control apparatus is operative to maintain substantially equal pressure drops across the inlet opening areas.

39. A method of controlling operation of multiple well tool assemblies positioned downhole in the wellbore of a subterranean well, the method comprising the steps of:

interconnecting multiple self-contained, electrically operable hydraulic pressure sources to corresponding ones of the well tool assemblies, each self-contained hydraulic pressure source being disposed downhole and including a first source of pressurized fluid operable to power the associated downhole well tool assembly via a first fluid circuit portion connected thereto, and a second source of pressurized fluid interposed in the first fluid circuit portion and being operable to selectively alter the routing of pressurized fluid to the associated downhole well tool assembly; and supplying electrical power to the hydraulic pressure sources.

40. The method of claim 39 further comprising the step of controlling the operation of the downhole well tool assemblies by sensing the magnitudes of predetermined operational parameters thereof and responsively controlling the operation of their associated first and second sources of pressurized fluid in a manner maintaining the magnitudes of the sensed operational parameters at predetermined levels.

41. The method of claim 40 wherein:

the downhole well tool assemblies are flow control devices mutually spaced apart along the length of the wellbore and having variable opening areas communicating exterior and interior portions thereof, and the sensing step is performed by sensing fluid pressure drops across the inlet opening areas.

42. The method of claim 41 wherein the controlling step is performed in a manner maintaining predetermined minimum fluid pressure drops across the inlet opening areas.

43. The method of claim 42 wherein the controlling step is performed in a manner maintaining minimum positive exterior-to-interior fluid pressure drops across the inlet opening areas.

44. The method of claim 40 wherein the controlling step is performed in a manner maintaining substantially equal pressure drops across the inlet opening areas.

45. Hydraulic actuator apparatus for use in controlling operation of a downhole well tool assembly, comprising:

a body having first and second bores extending therethrough, the first and second bores respectively having radially enlarged first and second cylinder portions with opposite ends;

a first rod reciprocably received in the first bore and having a laterally enlarged piston portion slidably received in the first cylinder portion and dividing it into opposite hydraulic chambers connectable to a first hydraulic circuit portion;

a second rod reciprocably received in the second bore and having a laterally enlarged piston portion slidably received in the second cylinder portion and dividing it into opposite hydraulic chambers connectable to a second hydraulic circuit portion;

a first drive portion carried by the body and having a first reversible electric motor drivingly connected to the first rod and operable to forcibly reciprocate it in the first bore; and a second drive portion carried by the body and having a second reversible electric motor drivingly connected to the second rod and operable to forcibly reciprocate it in the second bore.

46. The hydraulic actuator apparatus of claim 45 wherein the first and second drive portions project outwardly from an exterior surface of the body.

47. The hydraulic actuator apparatus of claim 45 wherein:

the first reversible electric motor is coupled through a gear structure to a ball screw structure which is drivingly connected to the first rod, and the second reversible electric motor is coupled through a gear structure to a ball screw structure which is drivingly connected to the second rod.

48. The hydraulic actuator apparatus of claim 45 further comprising:

a pilot check valve carried in the first bore and connectable to the first fluid circuit portion, the pilot check valve being selectively engageable by an end portion of the first rod to disable the fluid flow blocking function of the pilot check valve.

* * * * *